US010543417B2

(12) United States Patent
Leary

(10) Patent No.: US 10,543,417 B2
(45) Date of Patent: Jan. 28, 2020

(54) MOLDED COMPONENTS FOR PROTECTIVE EQUIPMENT

(71) Applicant: adidas AG, Herzogenaurach (DE)

(72) Inventor: Kevin Leary, Dedham, MA (US)

(73) Assignee: adidas AG, Herzogenaurach (DE)

( * ) Notice: Subject to any disclaimer, the term of this patent is extended or adjusted under 35 U.S.C. 154(b) by 277 days.

(21) Appl. No.: 14/704,328

(22) Filed: May 5, 2015

(65) Prior Publication Data

US 2016/0325173 A1 Nov. 10, 2016

(51) Int. Cl.
*A63B 71/14* (2006.01)
*A41D 19/015* (2006.01)

(52) U.S. Cl.
CPC ..... *A63B 71/141* (2013.01); *A41D 19/01523* (2013.01); *A63B 71/143* (2013.01)

(58) Field of Classification Search
CPC . A63B 71/141; A63B 71/143; A63B 2102/14; A63B 2102/24; A41D 19/01523
USPC ..... 2/161.1
See application file for complete search history.

(56) References Cited

U.S. PATENT DOCUMENTS 3,626,515 A * 12/1971 Murray ..... A63B 71/143 2/16
5,168,576 A * 12/1992 Krent ..... A41D 13/0156 2/16
5,488,739 A * 2/1996 Cardinal ..... A63B 71/143 2/16
2005/0091721 A1* 5/2005 Best ..... A63B 71/143 2/16
2007/0245451 A1* 10/2007 Desjardins ..... A41D 19/01523 2/159
2008/0034471 A1* 2/2008 Beland ..... A63B 71/143 2/161.6
2009/0019613 A1* 1/2009 Carcaterra ..... A63B 71/143 2/16
2009/0044306 A1* 2/2009 Lamson ..... A41D 19/01523 2/16
2011/0126342 A1* 6/2011 Bautista ..... A63B 71/143 2/161.1
2013/0269076 A1* 10/2013 Arnone ..... A41D 19/01523 2/20
2014/0137305 A1* 5/2014 Fisher ..... A41D 19/01517 2/20
2014/0143926 A1* 5/2014 Brown ..... A63B 71/143 2/20
2014/0373576 A1* 12/2014 Mak ..... A41D 19/01523 66/174

(Continued)

OTHER PUBLICATIONS

Cell-Flex Injection Molded Foam Products. Dertex Web. Accessed May 23, 2019 Retrieved Jun. 15, 2012. http://www.dertexcorp.com/injection-molded.html.*

*Primary Examiner* — Anne M Kozak
(74) *Attorney, Agent, or Firm* — Kilpatrirck Townsend & Stockton LLP

(57) ABSTRACT

Described are protective equipment items including a non-molded component joined to a molded component. The molded component includes a foam layer with an exterior layer and an interior layer, a plurality of molded grooves arranged in the exterior layer and the interior layer, wherein the plurality of molded grooves form bending areas in the three-dimensional molded component, and a fabric layer comprising a stretch material, wherein the fabric layer is bonded to the exterior layer.

14 Claims, 19 Drawing Sheets

(56) References Cited

U.S. PATENT DOCUMENTS

| | | | | |
|---|---|---|---|---|
| 2015/0106990 | A1* | 4/2015 | Gait | A63B 71/143 2/20 |
| 2015/0202521 | A1* | 7/2015 | Abdelmalek | A63B 71/141 2/20 |
| 2015/0265904 | A1* | 9/2015 | Lemieux | A63B 71/143 2/161.1 |
| 2016/0082342 | A1* | 3/2016 | Brown | A63B 71/143 2/20 |

* cited by examiner

MOLDED COMPONENTS FOR PROTECTIVE EQUIPMENT

FIELD OF THE INVENTION

The present invention relates to molded components for use in protective equipment such as sport gloves, in particular a lacrosse glove or hockey glove.

BACKGROUND

Protective equipment typically serves to protect body parts from injury by resisting or at least cushioning mechanical impacts. For example, in addition to improving the grip on the inner side of the hand, sports gloves also protects the hands from substantial mechanical loads.

Conventionally, such sports gloves have been formed from a number of parts that are individually sewn together. By using small individual components that are individually stitched together, the glove's flexibility is improved, but the assembly time and labor required to manufacture such gloves is extensive. For example, in a typical lacrosse glove, over thirty individual pieces are assembled and sewn together, which means over sixty pieces must be sewn together to create one pair. Furthermore, the conventional materials used to form such gloves tend to result in gloves are not substantially light-weight.

Thus, in certain embodiments, it may be desirable to find a way to minimize the number of individual pieces used to assemble sports gloves while maintaining or improving flexibility, as well as reducing labor and material costs and improving the ease of manufacturing and customization. Furthermore, it may be desirable to reduce the weight of the sports gloves through the use of lighter materials.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various embodiments of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

According to certain embodiments of the present invention, a sports glove comprises at least one non-molded component joined to at least one molded component, wherein the at least one molded component comprises a foam layer comprising an exterior layer and an interior layer, a plurality of molded grooves arranged in the exterior layer and the interior layer, wherein the plurality of molded grooves form bending areas in the molded component, and a fabric layer bonded to the exterior layer.

In some embodiments, the fabric layer comprises stretch properties that allow the fabric layer to conform to a molded shape of the foam layer. The exterior layer may comprise a first durometer, and the interior layer may comprise a second durometer. In certain embodiments, the first durometer is greater than the second durometer.

In some embodiments, the foam layer is formed of dual density ethyl vinyl acetate. The exterior layer may be formed of a rate sensitive material.

In certain embodiments, the at least one molded component comprises at least one of a hand portion, a cuff portion, and a wrist portion and/or at least one molded component comprises a flange that is stitched to an edge of the at least one non-molded component.

In certain embodiments, at least one non-molded component comprises a plurality of gussets, and the at least one molded component comprises a hand portion comprises a plurality of finger portions, wherein the plurality of gussets are stitched to the plurality of finger portions.

In some embodiments, the sports glove further comprises a palm material stitched to the plurality of gussets. In some embodiments, the at least one molded component further comprises at least one wrist portion stitched to the hand portion.

According to certain embodiments of the present invention, a protective equipment item comprises a non-molded component joined to a molded component, wherein the molded component comprises a foam layer comprising an exterior layer and an interior layer, a plurality of molded grooves arranged in the exterior layer and the interior layer, wherein the plurality of molded grooves form bending areas in the molded component, and a fabric layer comprising a stretch material, wherein the fabric layer is bonded to the exterior layer.

In some embodiments, the fabric layer comprises stretch properties that allow the fabric layer to conform to a molded shape of the foam layer. The exterior layer may comprise a first durometer, and the interior layer may comprise a second durometer. In certain embodiments, the first durometer is greater than the second durometer.

In some embodiments, the foam layer is formed of dual density ethyl vinyl acetate. The exterior layer may be formed of a rate sensitive material.

In certain embodiments, the at least one molded component comprises a flange that is stitched to an edge of the at least one non-molded component.

According to certain embodiments of the present invention, a method of manufacturing a protective equipment item comprising a non-molded component joined to a molded component comprises bonding a fabric layer and a foam layer, molding the bonded layers in a mold to form the molded component, cutting the molded component from the bonded layers, and assembling the molded component to the non-molded component.

In some embodiments, the molded component comprises a flange around at least a portion of an edge of the molded component, and the molded component is assembled to the non-molded component by joining an edge of the non-molded component to the flange of the molded component. In certain embodiments, the protective equipment item is a sports glove. In some embodiments, the fabric layer comprises synthetic leather.

BRIEF DESCRIPTION OF THE DRAWINGS

In the following detailed description, embodiments of the invention are described referring to the following figures.

DETAILED DESCRIPTION

Figure 1:
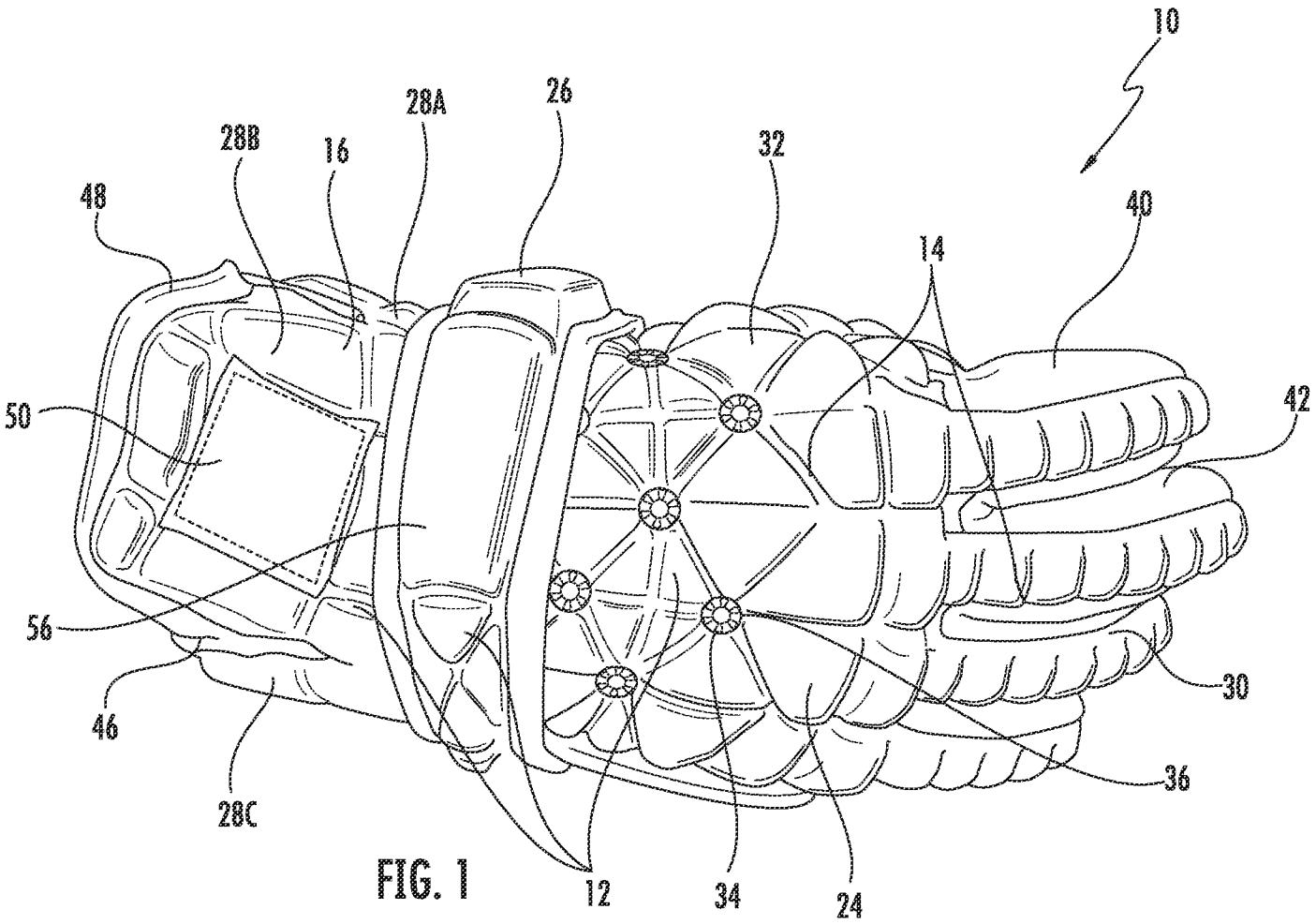
FIG. 1 is a top view of a sports glove, according to certain embodiments of the present invention.

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

According to certain embodiments of the present invention, as illustrated in FIGS. 1-4, a sports glove 10 comprises a plurality of molded components 12. In certain embodiments, each molded component 12 is formed from a fabric layer 16 and a foam layer 18.

In these embodiments, the fabric layer 16 may be formed of any fabric material having some stretch properties. For example, the fabric layer 16 may be formed of two-way stretch material up to and including four-way (or greater) stretch materials, such as Lycra®, Spandex, or any other suitable material having similar properties.

For example, in certain embodiments, the fabric layer 16 may comprise synthetic or faux "skin" materials, including but not limited to synthetic leathers or other faux products. In most conventional applications of faux or synthetic leather, a substrate is needed. In the present embodiments, the foam layer 18 may serve as the substrate, which allows the application to be thinner and lighter than conventional uses of synthetic leather or other similar materials. In certain embodiments, the fabric layer 16 may be formed of leather.

The foam layer 18 may be formed of an exterior layer 20 having a first durometer, and an interior layer 22 having a second durometer. In certain embodiments, the first durometer value is higher than the second durometer value. In certain embodiments, the second durometer value is the same as or higher than the first durometer value. Examples of suitable materials include but are not limited to dual density ethyl vinyl acetate ("EVA"), rubber, expanded thermoplastic polyurethane ("eTPU"), as well as other foams, such as thermoplastic polyurethane ("TPU"), expanded polypropylene ("EPP"), and polyurethane ("PU"). In some embodiments, the exterior layer 20 durometer may be 51 (and may further range from 15-65), and the interior layer durometer may be 35 (and may further range from 15-65).

In other embodiments, the exterior layer 20 (and/or the interior layer 22) may be a rate sensitive material that deforms easily under a softer impact to prevent milder injuries, while stiffening under a harder impact to prevent compressing or crushing to their ultimate limit and "bottoming out," which is understood by those of skill in the relevant to mean compressing to a point that the remainder of the impact energy is passed on directly to the body part that is being protected by the material. In these materials, the stress vs. strain characteristics are dependent on the rate of loading, so the harder the impact, the greater the resistance to the force. Examples of such materials are lightweight grades of PU and other similar materials. Examples of commercially available rate sensitive materials are offered by D30®, a British-based specialist materials company, at www.d3o.com/materials.

In some embodiments, the molded components 12 comprise a hand portion 24, a cuff portion 26, and/or at least one of three wrist portions 28A, 28B, 28C. In certain embodiments, all or a subset of the molded components 12 may be integrally formed as a single piece.

One or more of the molded components 12 may further comprise a plurality of molded grooves 14 that provide bending areas within each molded component 12. The molded grooves 14 may be positioned on the exterior layer 20, the interior layer 22, or both of one or more of the molded components 12 in locations where bending and/or flexibility is needed. For example, the molded grooves 14 on the exterior layer 20 may be aligned with the molded grooves 14 on the interior layer 22 (see e.g. main body 32 in FIGS. 11A-11D), the molded grooves 14 on the exterior layer 20 may be offset from the molded grooves 14 on the interior layer 22 (see e.g. finger portions 30 in FIGS. 11A-11D), and/or the molded grooves 14 may only appear on the interior layer 22 (see cuff portions 26 in FIGS. 14A-14D), and/or the molded grooves 14 may only appear on the exterior layer 20. The arrangement and location of the molded grooves 14 may vary as needed to form bending areas in the locations and directions needed for the particular sports application. Each molded groove 14 has a groove surface 21 defined by the layer on which it is arranged.

For example, as shown in FIGS. 11A-11D, in the finger portions 30 of the hand portion 24, the molded grooves 14 on the exterior layer 20 and the interior layer 22 may be arranged in a substantially parallel and offset configuration that allow the finger portions 30 to bend and flex easily.

In contrast, as shown in FIGS. 11A-11D, in a main body 32 of the hand portion 24, the molded grooves 14 on the exterior layer 20 and the interior layer 22 may be arranged to align with each other. In some cases, the molded grooves 14 may be arranged to intersect in certain locations, and an aperture 34 may be introduced at one or more of the intersection points to provide venting. In some cases, an eyelet 36 may be positioned within the aperture 34, as best shown in FIG. 1. The eyelet 36 may be formed of TPU, metal, or rubber, or other suitable material, and may comprise portions that are positioned on each side of the aperture 34 and snapped or fastened together, similar to a grommet, so as to also further minimize the amount of stitching needed and/or the time needed to assemble. In certain embodiments, the eyelet 36 comprises a hole formed through the material with no additional materials surrounding the aperture 34.

In certain embodiments, at least some of the edges of the molded components may comprise flanges 38. The flanges 38 may be approximately 8 mm in width, but may be wider or narrower as needed to achieve the desired result. The flanges 38 are provided as a location for stitching or to otherwise join the molded components 12 to each other and/or to other non-molded components 40. For example, as shown in FIGS. 1-4, in the hand portion 24, non-molded gussets 42 may be fastened to the flanges 38. These gussets 42 may be formed of breathable mesh or any other suitable flexible fabric. In certain embodiments, the gussets 42 may be turn stitched onto the flanges 38, but any suitable stitching technique may be used. Furthermore, a person of ordinary skill in the relevant art will understand that the gussets 42 may be attached to the flanges 38 using any suitable mechanical or chemical fasteners, including but not limited to gluing, fusing, injection molding, bonding or other material joining techniques.

Figure 4:
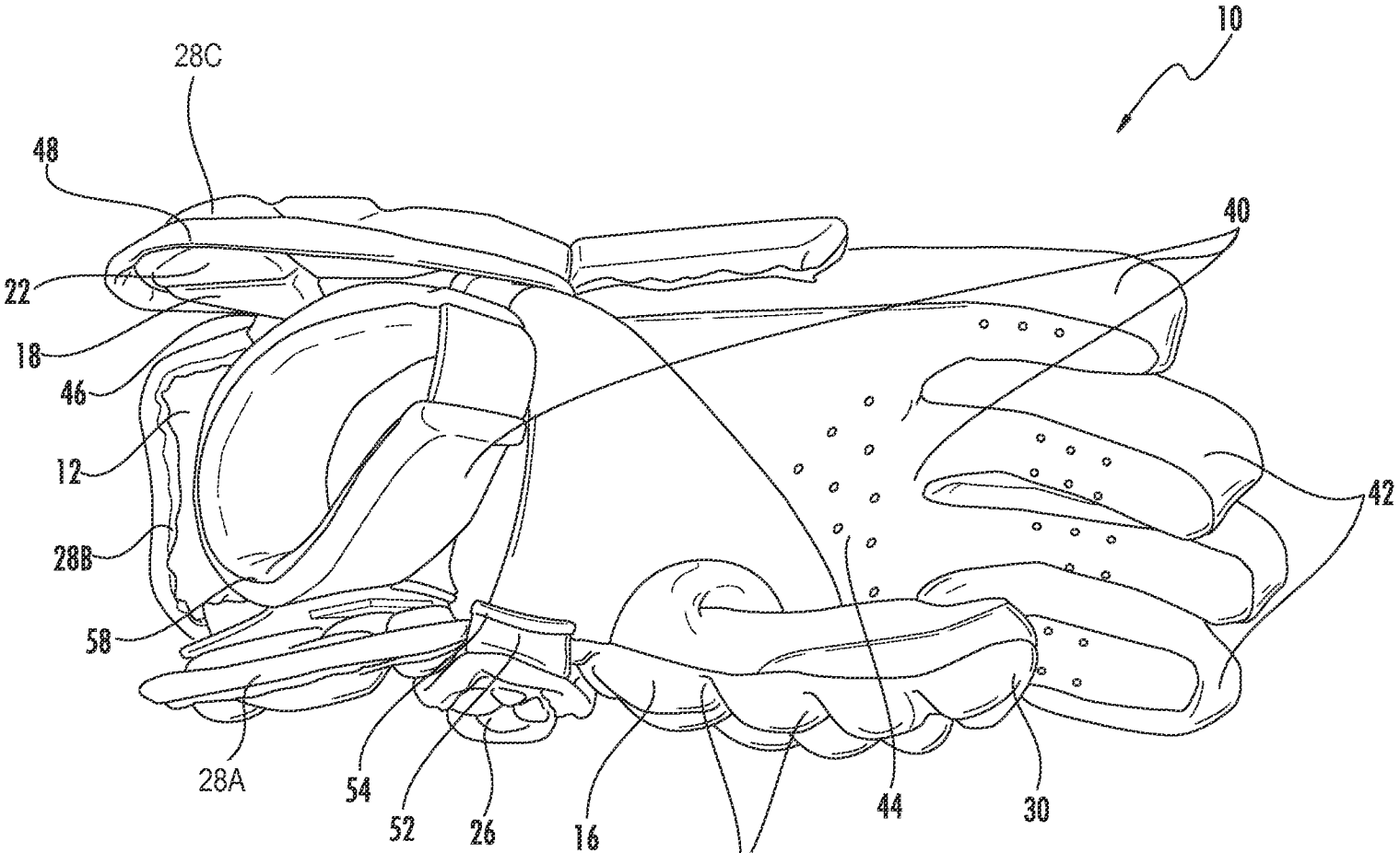
FIG. 4 is a bottom view of the sports glove of FIG. 1.
Figure 5:
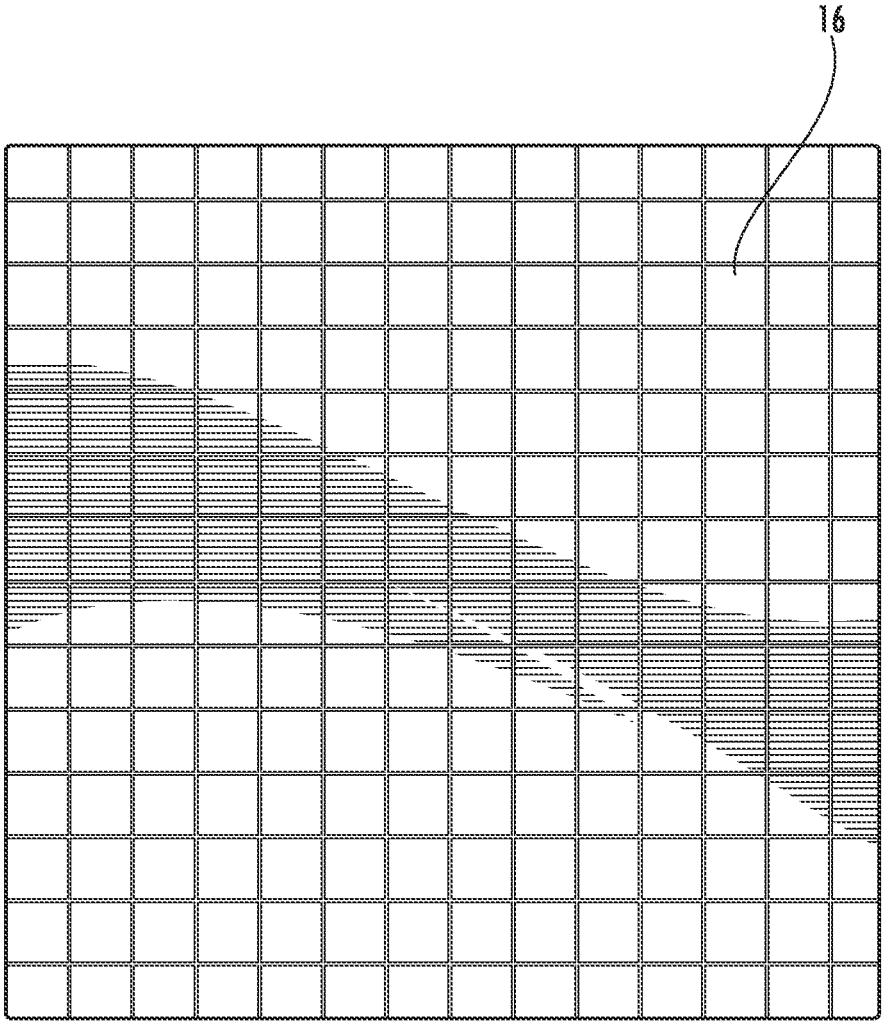
FIG. 5 is a view of a fabric layer bonded to a foam layer for use in forming molded components, according to certain embodiments of the present invention.
Figure 6:
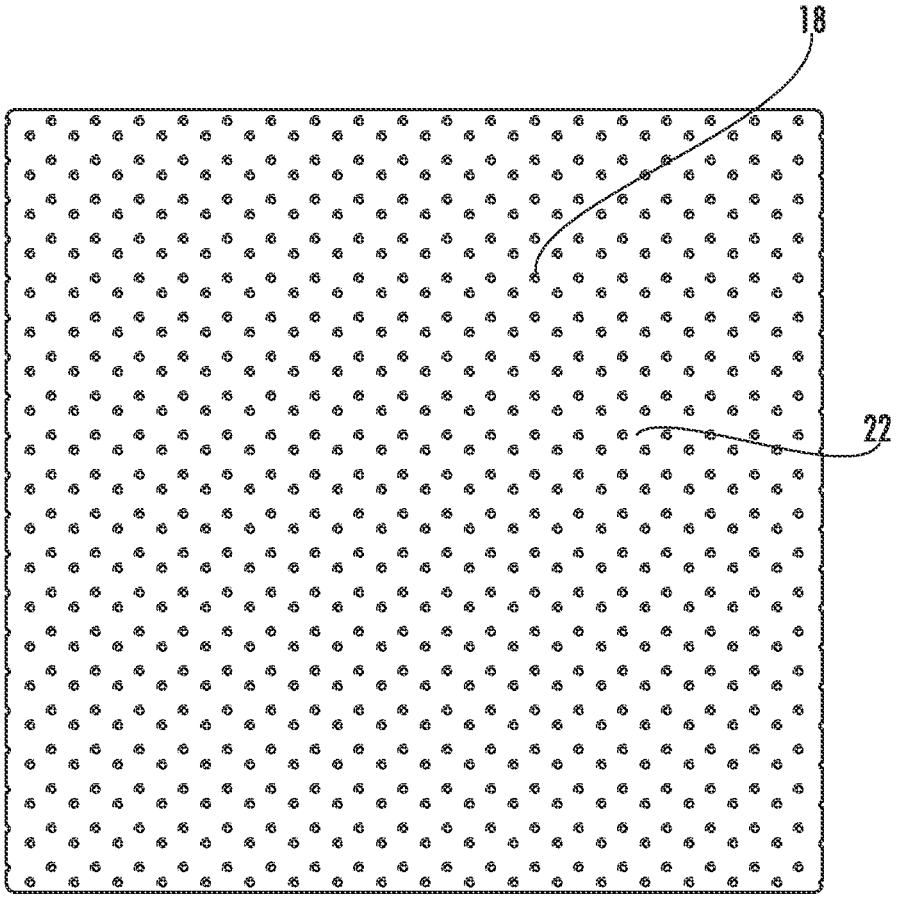
FIG. 6 is a view of an interior layer of the foam layer bonded to the fabric layer of FIG. 5.
Figure 7:
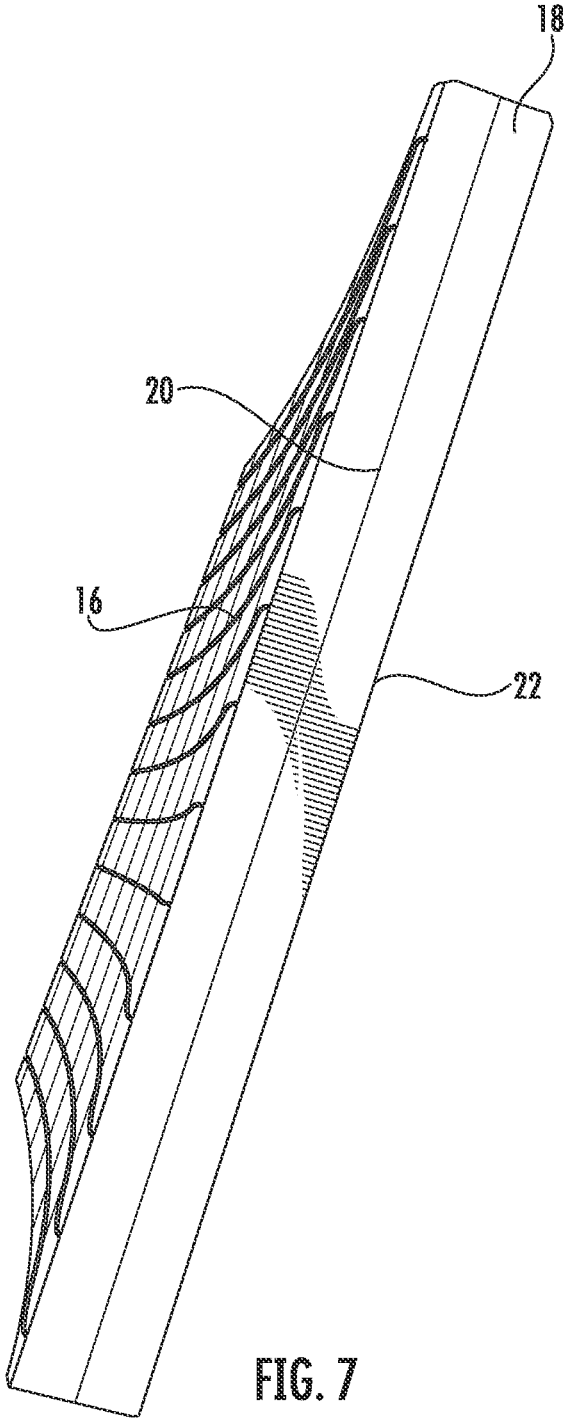
FIG. 7 is a side view of the bonded fabric layer and foam layer of FIG. 5.

As best illustrated in FIG. 4, a palm material 44 may be turn stitched onto an opposing side of the gussets 42, but any suitable stitching technique may be used. Furthermore, a person of ordinary skill in the relevant art will understand that the palm material 44 may be attached to the gussets 42 using any suitable mechanical or chemical fasteners, including but not limited to gluing, fusing, injection molding, bonding or other material joining techniques. In some embodiments, the palm material 44 and the gussets 42 may be a single, integrally formed material. In other embodiments, the palm material 44 may be formed of a more durable material fabric, such as leather, suede, synthetic leather, synthetic suede, or any other fabric conventionally used for palm applications of sports gloves 10. In other embodiments, the palm material 44 may include a material having gripping properties covering at least a portion of the palm. Examples of gripping materials that could be incorporated into the palm material or form an additional layer over at least a portion of the palm material include silicone, rubber, or TPU.

The wrist portions 28A, 28B, 28C may be attached to the flange 38 along an end of the hand portion 24 that is substantially opposite the finger portions 30. To provide additional flexibility, the wrist portions 28A, 28B, 28C may be molded as three separate pieces also having flanges 38 for attaching to each other and the flange 38 of the hand portion 24. In other embodiments, the wrist portions 28A, 28B, 28C may be molded as a single, integrally formed piece.

In certain embodiments, the central wrist portion 28B is at least partially joined to each of the side wrist portions 28A, 28C via an elastic fabric 46 or other similar stretchable material that allows the wrist portions 28A, 28B, 28C to stretch away from each other and bend in different directions with the wrist movement of a wearer. A trim piece 48 may be attached via any suitable mechanical or chemical coupling method to the remaining edges of the flanges 38 that are not already attached to another flange 38 and/or the elastic fabric 46.

Figure 3:
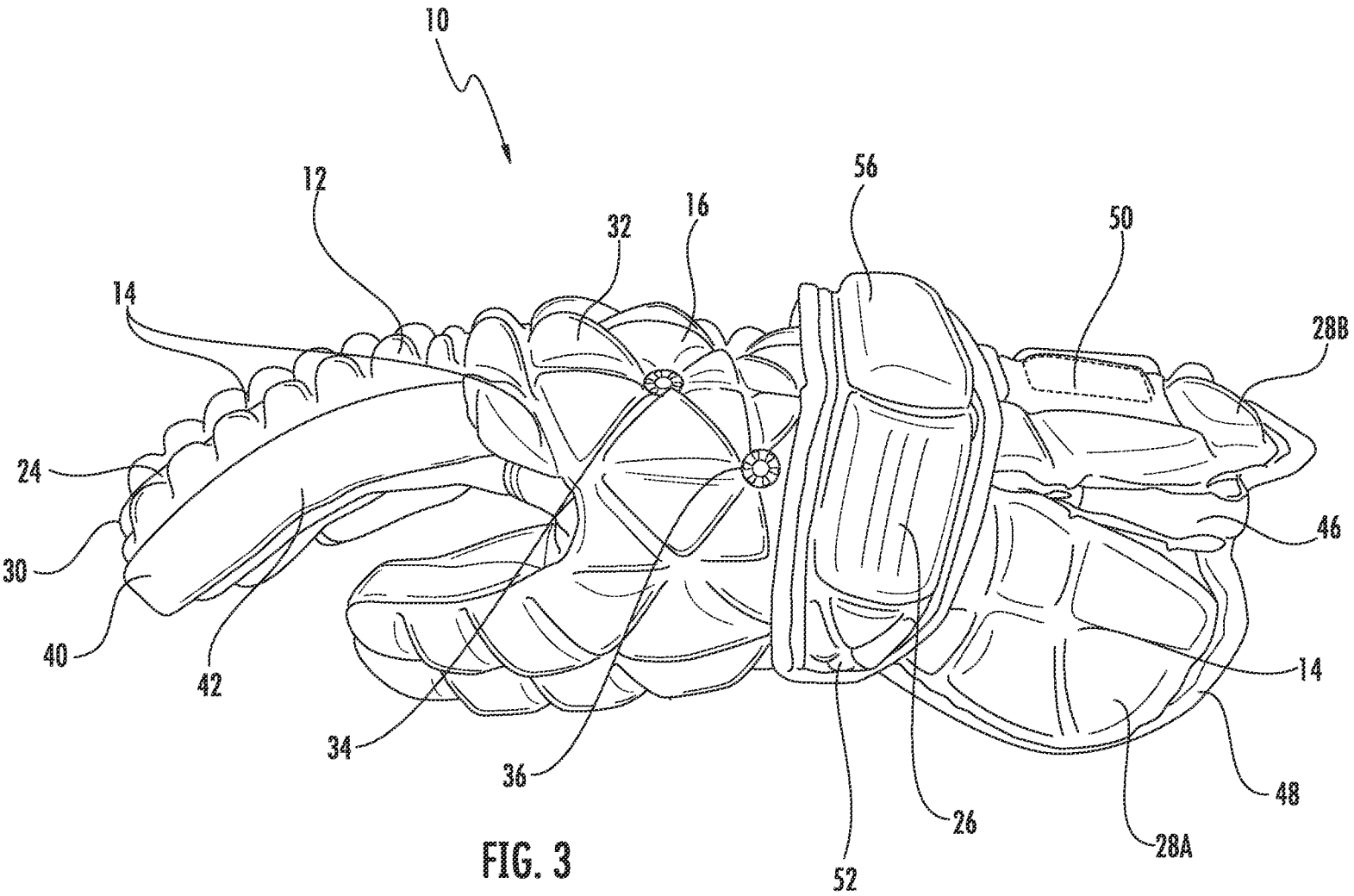
FIG. 3 is a medial side view of the sports glove of FIG. 1.

In certain embodiments, a logo or other decorative item 50 may be attached to an upper surface of the fabric layer 16, as shown in FIGS. 1 and 3. In certain embodiments, the decorative item 50 may be printed within the fabric layer 16. As illustrated in FIGS. 5-10, and described in more detail below, the decorative item 50 may be printed in a distorted manner on the two-dimensional fabric layer 16 so that the decorative item 50 will appear correctly within the fabric layer 16 after the wrist portion 28B (or any other molded component 12 with the decorative item 50) has been molded into its three-dimensional shape. In some embodiments, the logo or other decorative item 50 may be molded directly into the molded component 12. In further embodiments, the logo or other decorative item 50 may include a fabric (woven or non-woven) label logo, a rubber logo, an embroidered logo, or other similar applications.

Figure 2:
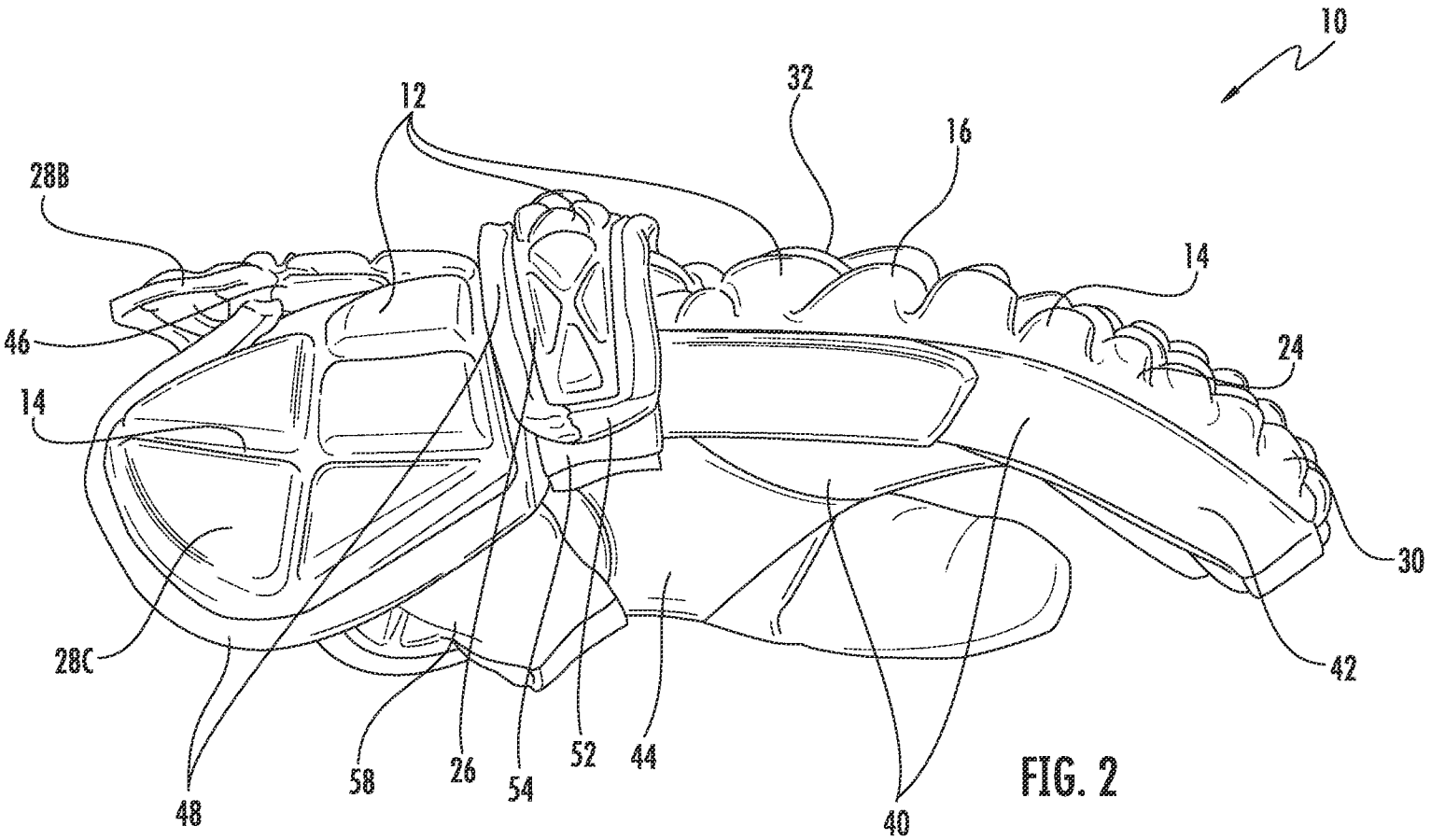
FIG. 2 is a lateral side view of the sports glove of FIG. 1.

The cuff portion 26 may be attached at each end 52 to the hand portion 24, the wrist portions 28A, 28C and/or to the palm material 44. As illustrated in FIGS. 2 and 4, an elastic fabric 54 is attached via any suitable mechanical or chemical coupling method to the flanges 38 at the ends 52 of the cuff portion 26. The elastic fabric 54 is then attached via any suitable mechanical or chemical coupling method to the flanges 38 of the hand portion 24 adjacent locations where a portion of the palm material 44 is also attached to the flanges 38.

To ensure that the cuff portion 26 is not too stiff, as best illustrated in FIGS. 14A-14D, a series of molded grooves 14 may be arranged in a substantially parallel configuration on the interior layer 22 of the cuff portion 26. A region 56 of the exterior layer 20 opposite the location of the molded grooves 14 on the interior layer 22 may not include corresponding molded grooves 14. The inclusion of the molded grooves 14 on only one side of the cuff portion 26 allows the cuff portion 26 to flexibly conform to the shape of the wearer's wrist and hand, while also providing appropriate protection of the wearer's wrist.

In some embodiments, a logo or other decorative item 50 may be molded into the region 56 of the exterior layer 20. In other embodiments, the logo or other decorative item 50 may be printed in a distorted manner on the two-dimensional fabric layer 16 so that the decorative item 50 will appear correctly within the fabric layer 16 after the cuff portion 26 has been molded into its three-dimensional shape. In yet other embodiments, the region 56 may comprise a cavity that is configured for separate insertion of a logo or other decorative item 50 after the sports glove 10 has been manufactured.

Additional trim pieces 48 may be attached via any suitable mechanical or chemical coupling method to the remaining portions of the flanges 38 that are not already attached to either another flange 38 or the elastic fabric 54.

While the cuff portion 26 and the hand portion 24 may be formed as a single molded piece with a series of molded grooves 14, the cuff portion 26 and/or the hand portion 24 may be formed of multiple molded pieces joined with an elastic fabric, as shown for the wrist portions 28A, 28B, 28C. Furthermore, multiple pieces may be included in any suitable number and location as needed to achieve the desired flexibility and movement.

As shown in FIG. 4, the palm side of the sports glove 10 further comprises a collar 58 that wraps around a wrist of the wearer when the sports glove 10 is worn. The collar 58 may be positioned below the wrist portions 28A, 28B, 28C, and may be fastened to the sports glove 10 using hook and loop fasteners, string, or other suitable fasteners. The collar 58 may be formed of any suitable cushioning materials, including but not limited to foams such as EVA, rubber, and eTPU, as well as other foams, such as TPU, EPP, and PU. In certain embodiments, the collar 58 may not be formed through the molding process used for the other molded components 12, but instead is formed using conventional forming methods. The collar 58 may be attached to the interior layer 22 of the wrist portions 28A, 28B, and/or 28C using hook and loop fasteners or any other suitable releasable or non-releasable mechanical fasteners or other coupling techniques.

Figure 15:
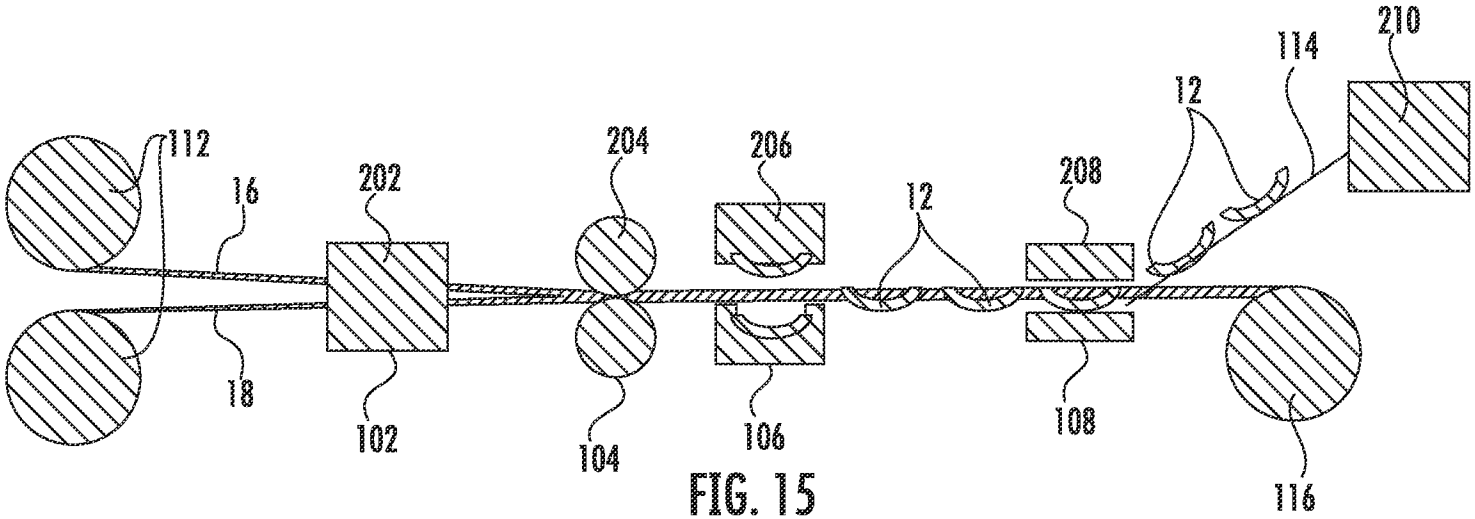
FIG. 15 is a side view of a process for manufacturing protective equipment using molded components, according to certain embodiments of the present invention.
Figure 16:
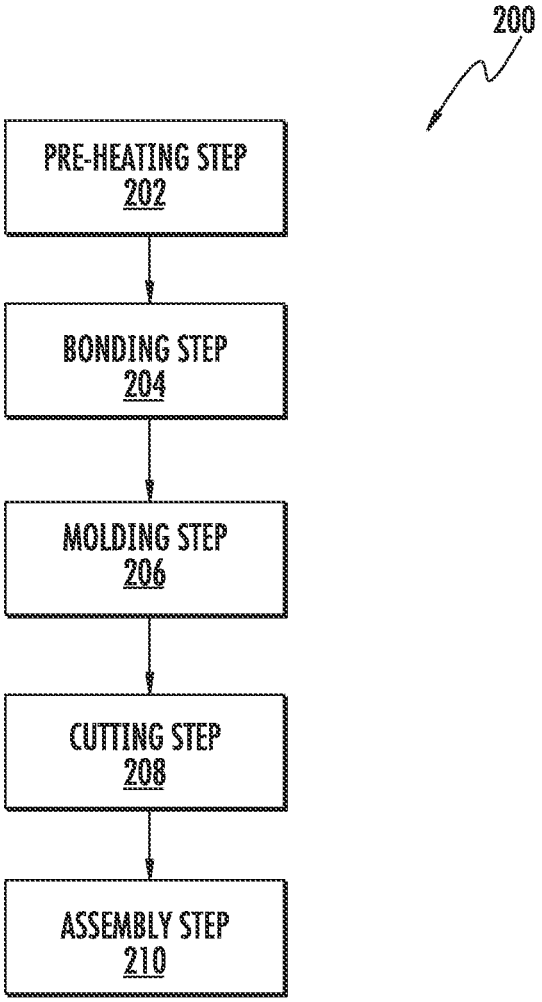
FIG. 16 is a flow diagram outlining the steps of a process for manufacturing protective equipment using molded components, according to certain embodiments of the present invention.

According to certain embodiments of a method 200 of manufacturing the sports glove 10, as illustrated in FIGS. 15 and 16, the fabric layer 16 and the foam layer 18 may be pre-heated in a pre-heating step 202. The pre-heating step 202 may comprise an oven 102 or other heating device. The layers 16, 18 may be pre-heated to the same temperature or different temperatures, depending on the materials used in each layer. For example, in certain embodiments, the layers 16, 18 may be pre-heated to a temperature in a range of approximately 100° C.-140° C.

The fabric layer 16 is cemented, glued, or otherwise adhered to the foam layer 18 in a bonding step 204. In some embodiments, the materials used to form the layers 16, 18 may bond directly to one another by pressing the materials together with a nip roller or other pressing device 104 following the pre-heating step 202 so that no additional adhesive or cement is needed in the bonding step 204.

An exemplary embodiment of the bonded layers 16, 18 is shown in FIGS. 5-8, where the fabric layer 16 has been printed with a checker-board pattern to demonstrate how the two-dimensional shape changes during molding, which can be helpful for designing a decorative item 50 into the fabric layer 16 so that it will appear correctly in the three-dimensional molded component.

The bonded layers 16, 18 are then placed on a mold 106 in a molding step 206. In this step, the materials may be warm from the pre-heating step 202, but the mold may be cold so that the pressure applied by plates of the mold 106 imparts the molded shape to the bonded layers 16, 18 without the use of additional heat. In other embodiments, a heated mold 106 may be used, depending on the particular materials used for the foam layer 18. In certain embodiments, the bonded layers 16, 18 may be injected into the heated mold. In further embodiments, the fabric layer 16 may be glued/adhered to the foam layer 18 (before or after molding) and/or the fabric layer 16 may be included in the mold. FIGS. 8-10 and 13 illustrate the three-dimensional appearance of the bonded layers 16, 18 after exiting the mold 106.

After the molding step 206, the molded layers 16, 18 are processing through a cutting step 208, which removes the molded component 12 from the surrounding layers 16, 18 and also imparts the flange 38 around the edges of the molded component 12. The cutting step 208 may comprise a die cutter 108 or other suitable trimming tool. FIGS. 11A-11D, 12A-12L, and 14A-14D illustrate the appearance of the molded components 12 after the cutting step 208.

Figure 8:
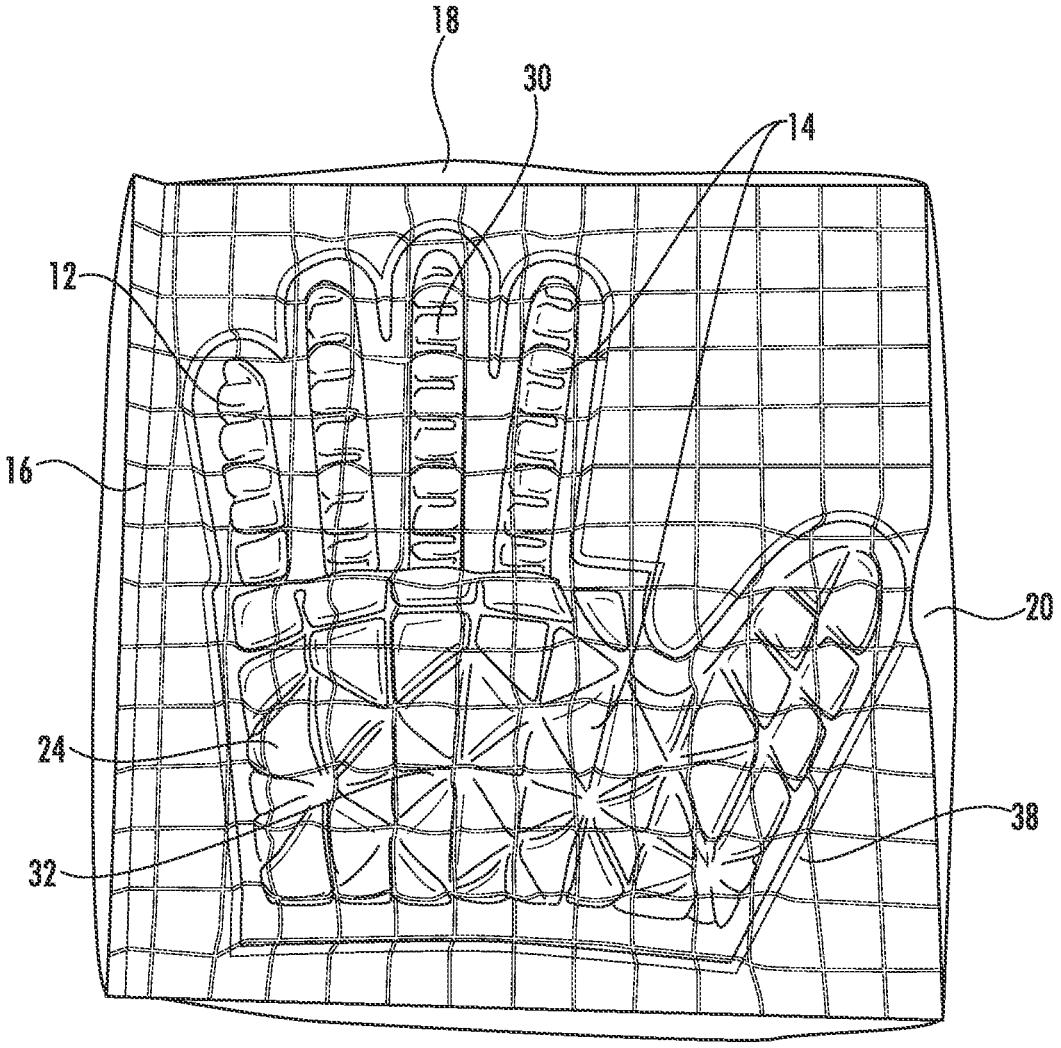
FIG. 8 is a view from the fabric layer side of the bonded fabric layer and foam layer of FIG. 5 with a molded hand portion.
Figure 9:
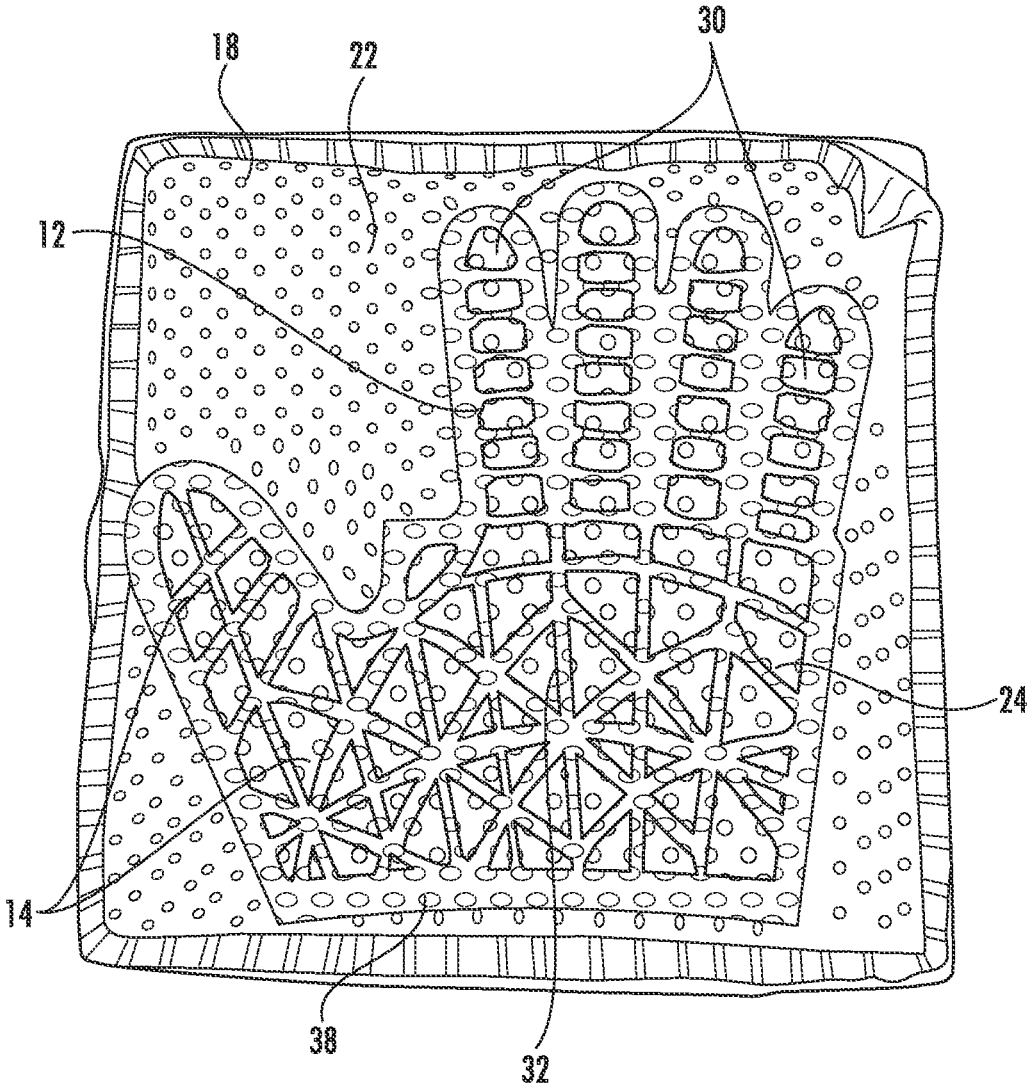
FIG. 9 is a view from the interior layer side of the bonded fabric layer and foam layer of FIG. 6 with a molded hand portion.
Figure 10:
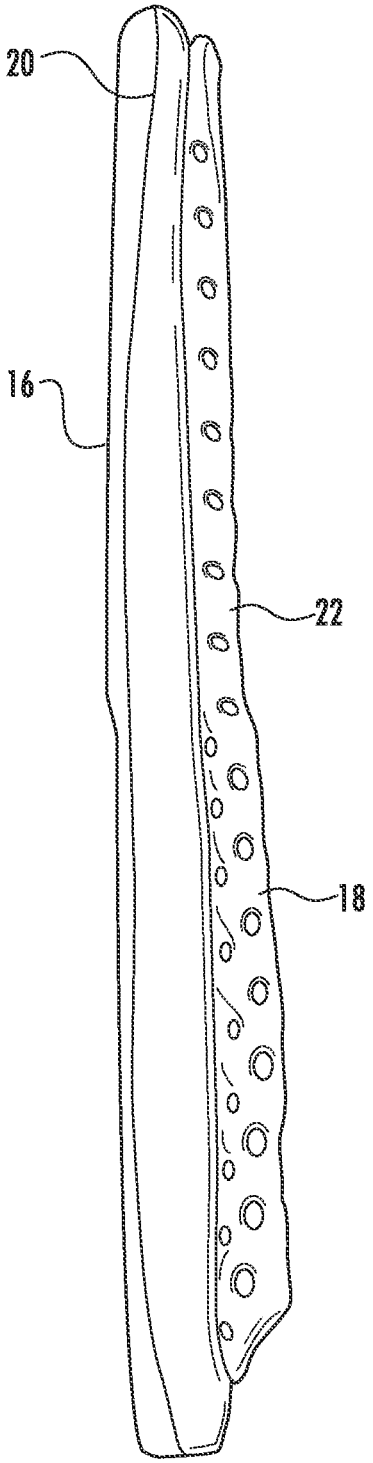
FIG. 10 is a side view of the bonded fabric layer and foam layer of FIG. 7 with a molded hand portion.
Figure 11A:
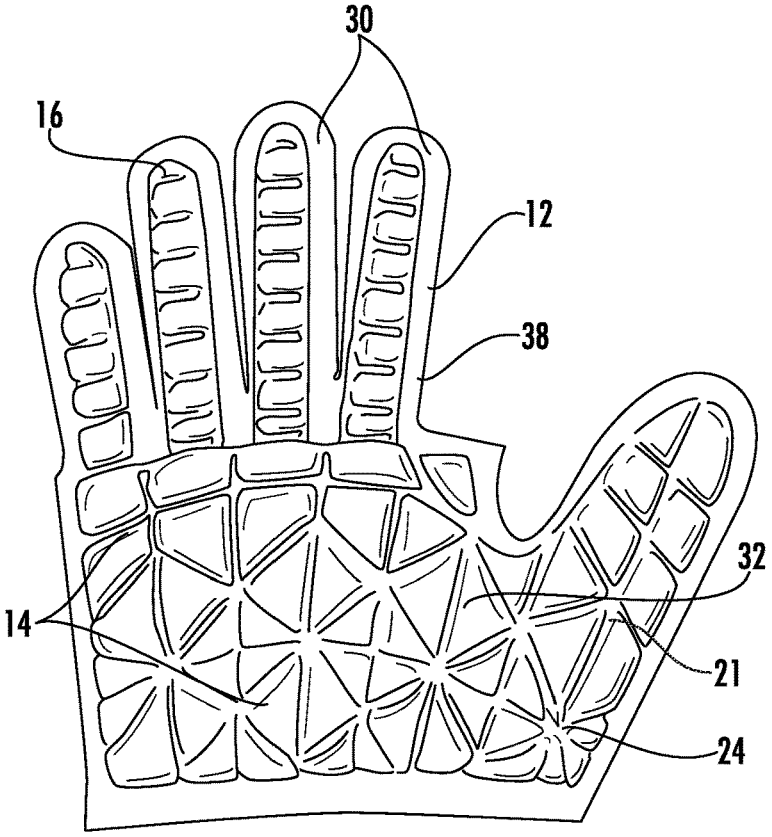
FIGS. 11A and 11B are views from a fabric layer side of a left-handed molded hand portion and a right-handed molded hand portion, respectively, after removal from a bonded fabric layer and foam layer, according to certain embodiments of the present invention.
Figure 11B:
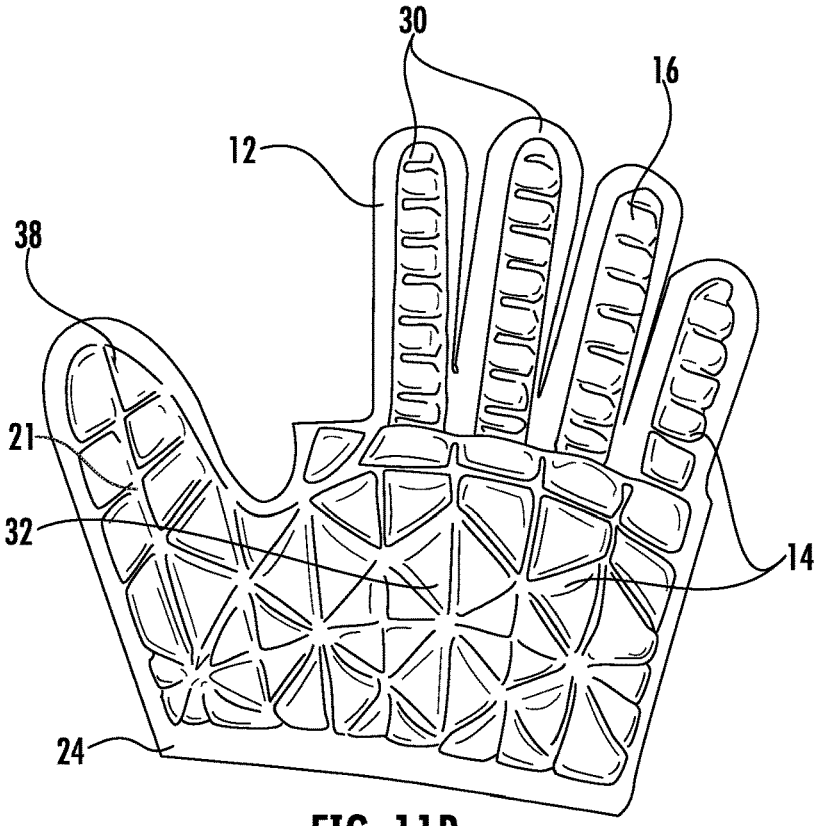
Figure 11C:
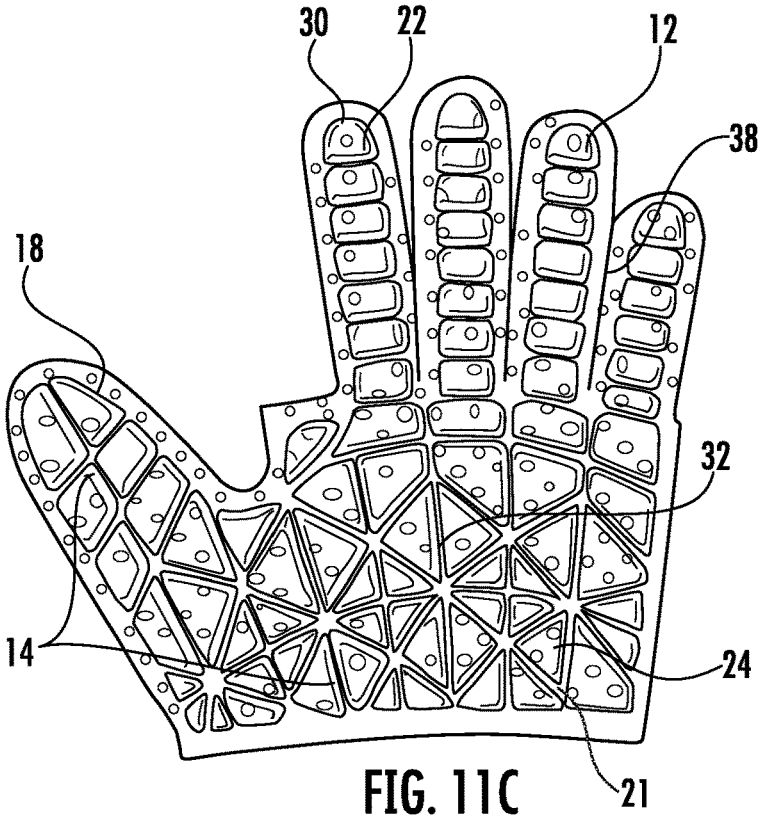
FIGS. 11C and 11D are views from an interior layer side of the left-handed molded hand portion and the right-handed molded hand portion of FIGS. 11A and 11B, respectively.
Figure 11D:
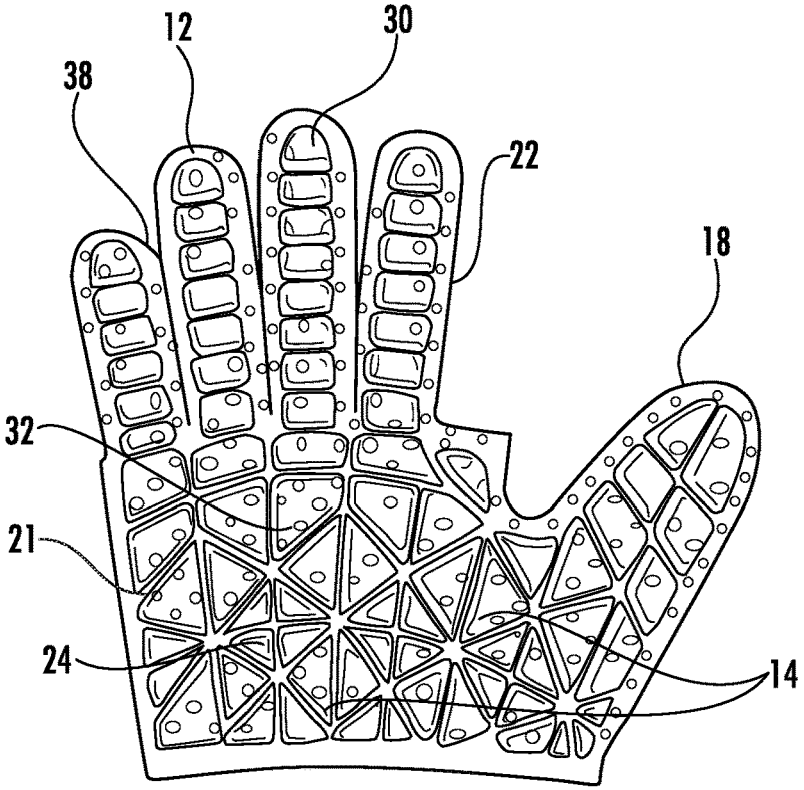
Figure 12A:
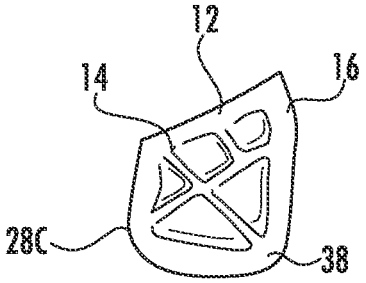
FIGS. 12A-12C are views from a fabric layer side of molded wrist portions for a left-handed glove after removal from a bonded fabric layer and foam layer, according to certain embodiments of the present invention.
Figure 12B:
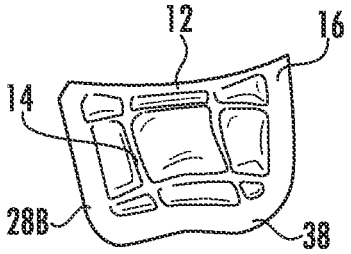
Figure 12C:
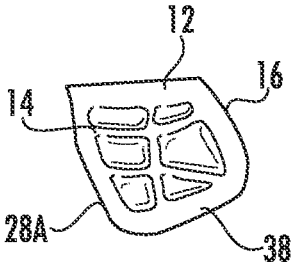
Figure 12D:
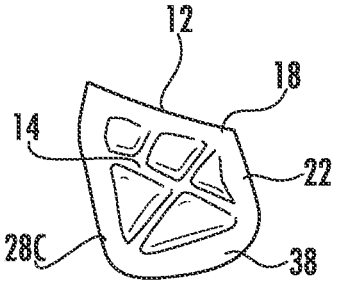
FIGS. 12D-12F are views from an interior layer side of the molded wrist portions of FIGS. 12A-12C.
Figure 12E:
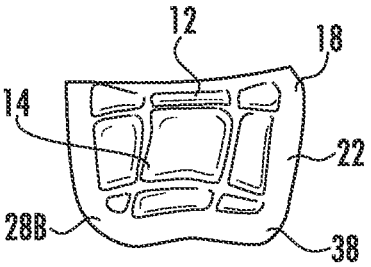
Figure 12F:
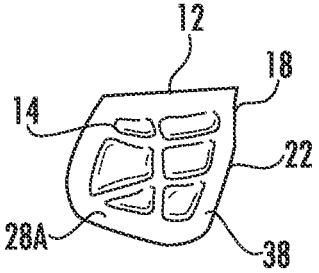
Figure 12G:
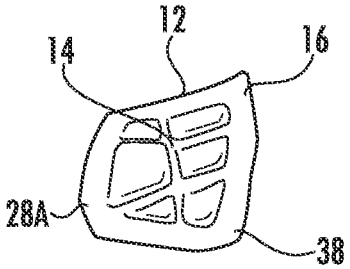
FIGS. 12G-12I are views from a fabric layer side of molded wrist portions for a right-handed glove after removal from a bonded fabric layer and foam layer, according to certain embodiments of the present invention.
Figure 12H:
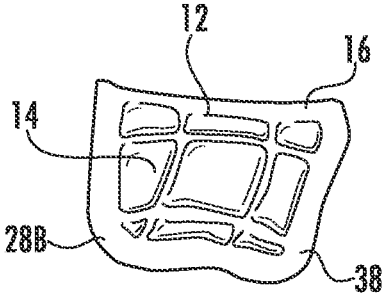
Figure 12I:
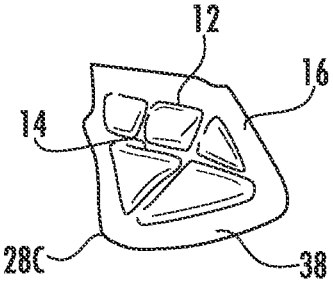
Figure 12J:
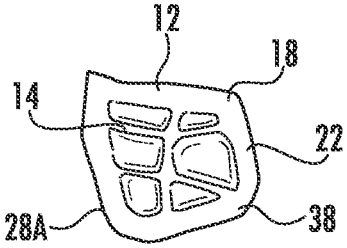
FIGS. 12J-12L are views from an interior layer side of the molded wrist portions of FIGS. 12G-12I.
Figure 12K:
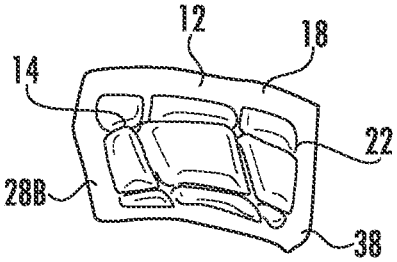
Figure 12L:
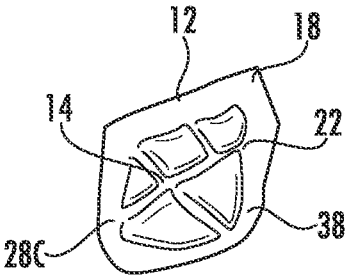
Figure 13:
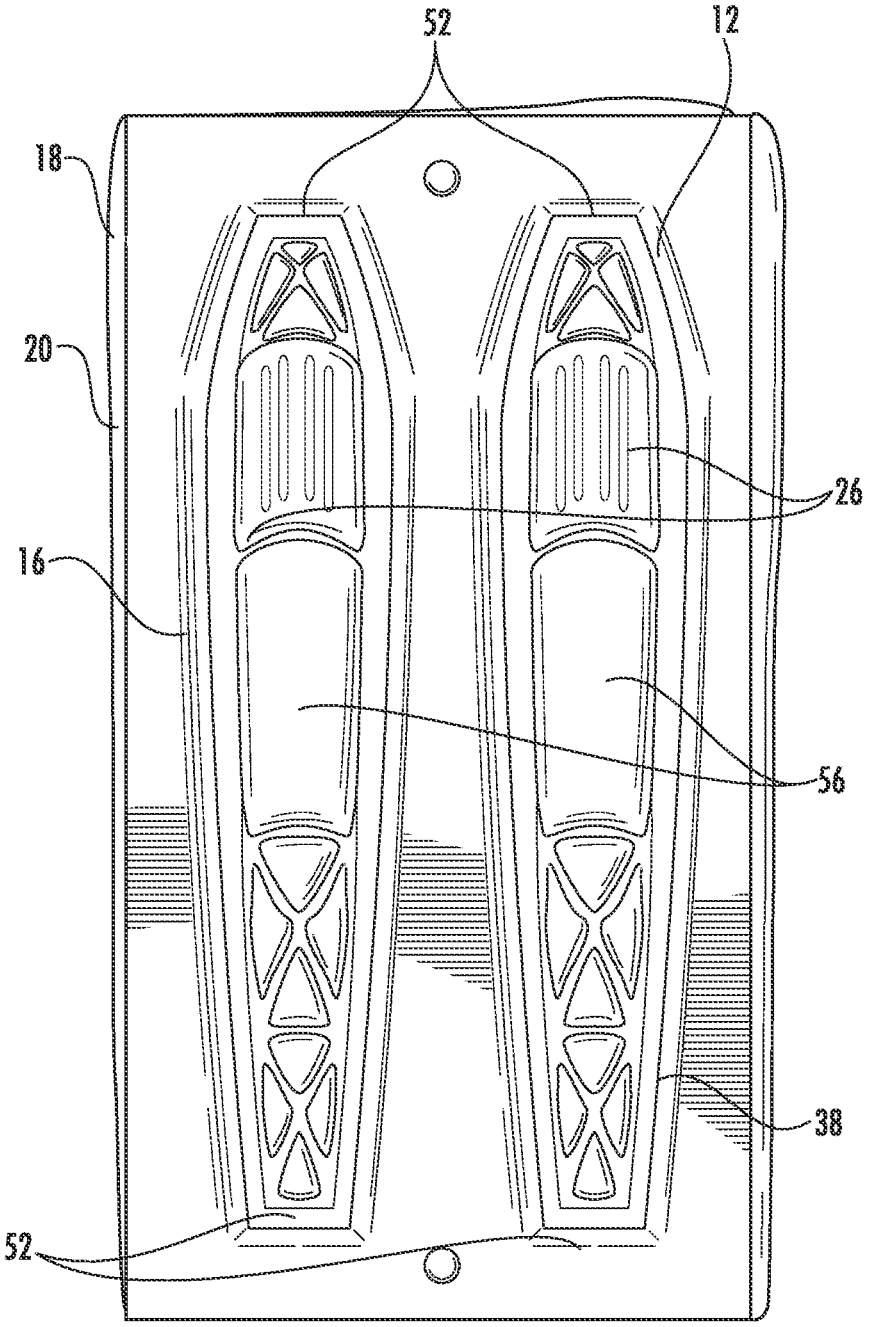
FIG. 13 is a view from a fabric layer side of a fabric layer bonded to a foam layer with a molded left-hand cuff portion and a molded right-hand cuff portion, according to certain embodiments of the present invention.
Figure 14A:
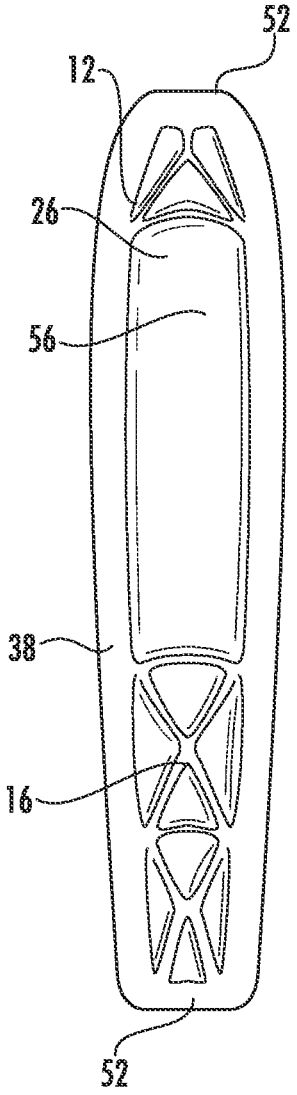
FIGS. 14A and 14B are views from a fabric layer side of a left-handed molded cuff portion and a right-handed molded cuff portion, respectively, after removal from a bonded fabric layer and foam layer, according to certain embodiments of the present invention.
Figure 14B:
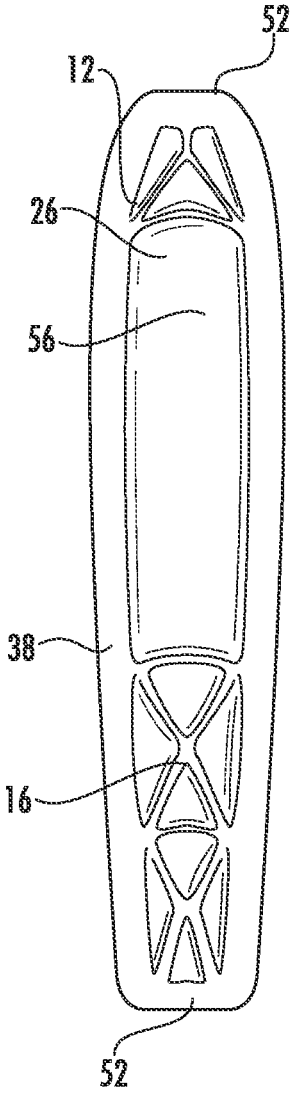
Figure 14C:
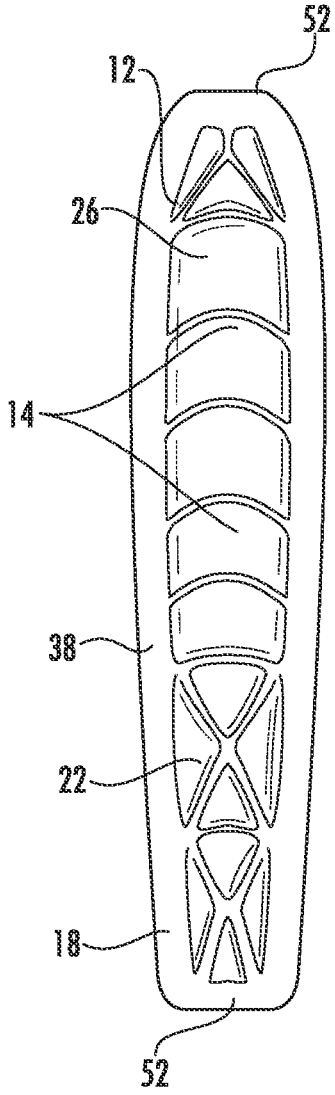
FIGS. 14C and 14D are views from an interior layer side of the left-handed molded cuff portion and the right-handed molded cuff portion of FIGS. 14A and 14B, respectively.
Figure 14D:
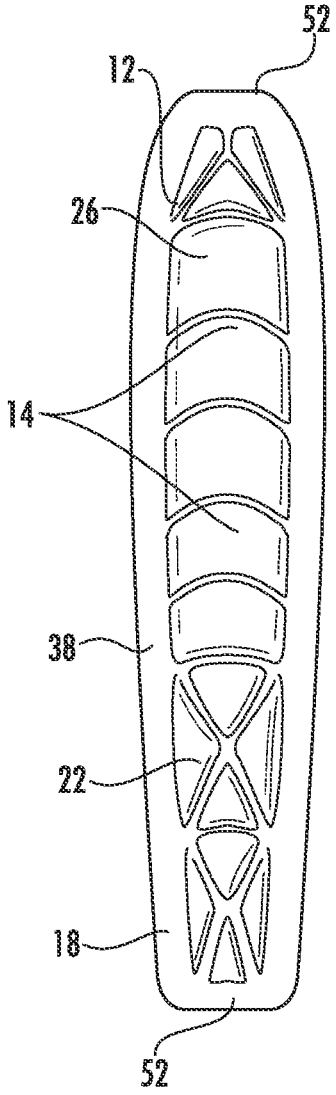

In the molding step 206 and the cutting step 208, one or more of the molded components 12 may be formed simultaneously, depending on the pattern, the size of the mold 106, and/or the size of the die cutter 108. For example, as shown in FIGS. 8-9, the hand portion 24 may be formed separately from the wrist portions 28A, 28B, 28C and the cuff portion 26. In other embodiments, all of these components 12 may be arranged in a single mold and die cut pattern so that all of the molded components 12 are formed simultaneously. In yet other embodiments, the wrist portions 28A, 28B, 28C may be formed simultaneously, with the cuff portion 26 and hand portion 24 being formed separately. In still further embodiments, the left-hand and right-hand versions of each component, such as the left-hand and right-hand components of the hand portions 24 may be formed simultaneously, the left-hand and right-hand wrist portions 28A and/or 28B and/or 28C may be formed simultaneously, and the left-hand and right-hand cuff portions 26 may be formed simultaneously (as shown in FIG. 13). In still further embodiments, the hand portion 24, wrist portions 28A, 28B, 28C, and cuff portion 26 may be formed simultaneously as a single piece.

Once the molded components 12 exit the cutting step 208, the molded components 12 and the non-molded components 40 (such as the gussets 42, palm material 44, elastic fabric pieces 46, 54, collar 58, and trim pieces 48) are assembled in the assembly step 210 using conventional stitching or other mechanical or chemical attachment methods. If apertures 34 have been added to the hand portion 24 (or any other molded components 12), eyelets 36 may be installed in these apertures 34 as part of the assembly step 210.

Some or all of the above steps 202-210 may be performed as batch, semi-bath, or flow process steps. For example, the fabric layer 16 and the foam layer 18 may be provided in rolls 112, which are unwound and fed through the pre-heater 102 in the pre-heating step 202, bonded via the press 104 (without or without the addition of additional cement or other adhesives) in the bonding step 204, fed into the mold 106 in the molding step 206, and finally fed into the die cutter 108 in the cutting step 208. The molded components 12 may be collected by a conveyor 114, and the scrap material may be collected on a rewind stand 116 at the end of the process. In other embodiments, the layers 16, 18 may be unwound and fed through the pre-heating step 202 and the bonding step 204, after which the bonded layers 16, 18 may be cut into sheets, which are then moved through the molding steps 206 and the cutting steps 208 as a batch process. Any suitable combination of batch, semi-batch, or continuous flow steps may be used as needed or desired to achieve the desired throughput and efficiency.

The use of molded components 12 in place of traditional components, which can number approximately 30 or more individual pieces alone within a single sports glove that must be sewn or otherwise assembled together, saves an extensive amount of assembly time, which translates directly into reduced labor costs, reduced manufacturing time, and less waste. In addition, the molded components 12 are significantly lighter than the weight of conventional components, in certain embodiments, resulting in a weight reduction ranging from 10%-25% in certain embodiments, and more specifically in a range of 15%-20% in further embodiments, and more specifically approximately 17% in still further embodiments for the sports glove 10. The use of molded components 12 also provides more complete protection because there are no seams like traditional gloves, thus translating into an increase in the protected surface area, and the finger portions 30 may be imparted with a crowned/curved shape to better contour to the rounded shape of the fingers for additional protection. Additional benefits include the ease of graphics customization, which enables the use of sublimation printing, custom colors, team colors/graphics, etc.

While FIGS. 1-4 specifically illustrate a sports glove 10 for lacrosse, the same process may be used to form molded components 12 for use with any type of sports glove 10, including but not limited to hockey, boxing, football, weight lifting, skateboarding, motorcycle, racing, soccer, goaltending, baseball gloves, football, rugby, and any other activity (sports or non-sports related). Further, the same process may be used to form molded components 12 for use with any type of protective equipment item, including but not limited to helmets, elbow pads, knee pads, shin guards, wrist guards, chest protectors, safety shoes, football pads, and any other type of protective device (sports or non-sports related).

In the following, further examples are described to facilitate the understanding of the invention:

1. A sports glove comprising at least one non-molded component joined to at least one molded component, wherein the at least one molded component comprises
   a foam layer comprising an exterior layer and an interior layer;
   a plurality of molded grooves arranged in the exterior layer and the interior layer, wherein the plurality of molded grooves form bending areas in the molded component; and
   a fabric layer bonded to the exterior layer.
2. The sports glove according to the preceding example, wherein the fabric layer comprises stretch properties that allow the fabric layer to conform to a molded shape of the foam layer.
3. The sports glove according to one of the preceding examples, wherein the exterior layer comprises a first durometer, and the interior layer comprises a second durometer.
4. The sports glove according to the preceding example 3, wherein the first durometer is greater than the second durometer.
5. The sports glove according to the preceding example 4, wherein the foam layer is formed of dual density ethyl vinyl acetate.
6. The sports glove according to one of the preceding examples 3-5, wherein the exterior layer is formed of a rate sensitive material.
7. The sports glove according to one of the preceding examples, wherein the at least one molded component comprises at least one of a hand portion, a cuff portion, and a wrist portion.
8. The sports glove according to one of the preceding examples, wherein the at least one molded component comprises a flange that is stitched to an edge of the at least one non-molded component.
9. The sports glove according to the preceding example 8, wherein the at least one non-molded component comprises a plurality of gussets, and the at least one molded component comprises a hand portion comprises a plurality of finger portions, wherein the plurality of gussets are stitched to the plurality of finger portions.
10. The sports glove according to the preceding example 9, further comprising a palm material stitched to the plurality of gussets.
11. The sports glove according to the preceding example 10, wherein the at least one molded component further comprises at least one wrist portion stitched to the hand portion.
12. A protective equipment item comprising
    a non-molded component joined to a molded component, wherein the molded component comprises
    a foam layer comprising an exterior layer and an interior layer;
    a plurality of molded grooves arranged in the exterior layer and the interior layer, wherein the plurality of molded grooves form bending areas in the molded component; and
    a fabric layer comprising a stretch material, wherein the fabric layer is bonded to the exterior layer.
13. The protective equipment item according to the preceding example 12, wherein the fabric layer comprises stretch properties that allow the fabric layer to conform to a molded shape of the foam layer.
14. The protective equipment item according to one of the preceding examples 12-13, wherein the exterior layer comprises a first durometer, and the interior layer comprises a second durometer.
15. The protective equipment item according to the preceding example 14, wherein the first durometer is greater than the second durometer.
16. The protective equipment item according to the preceding example 15, wherein the foam layer is formed of dual density ethyl vinyl acetate.
17. The protective equipment item according to one of the preceding examples 14-16, wherein the exterior layer is formed of a rate sensitive material.
18. The protective equipment item of according to one of the preceding examples 12-17, wherein the at least one molded component comprises a flange that is stitched to an edge of the at least one non-molded component.
19. A method of manufacturing a protective equipment item comprising a non-molded component joined to a molded component, the method comprising
    bonding a fabric layer and a foam layer;
    molding the bonded layers in a mold to form the molded component;
    cutting the molded component from the bonded layers;
    assembling the molded component to the non-molded component.
20. The method according the preceding example 19, wherein the molded component comprises a flange around at least a portion of an edge of the molded component, and the molded component is assembled to the non-molded component by joining an edge of the non-molded component to the flange of the molded component.
21. The method according to one of the preceding examples 19-20, wherein the protective equipment item is a sports glove.
22. The method according to one of the preceding examples 20-21, wherein the fabric layer comprises synthetic leather.

Different arrangements of the components depicted in the drawings or described above, as well as components and steps not shown or described are possible. Similarly, some features and sub-combinations are useful and may be employed without reference to other features and sub-combinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications may be made without departing from the scope of the claims below.

That which is claimed is:

1. A sports glove comprising:

at least one non-molded component; and at least one molded component joined to the at least one non-molded component, wherein the at least one molded component comprises:

a foam layer comprising an exterior layer and an interior layer, the exterior layer comprising a first outer surface of the foam layer facing a first direction and the interior layer comprising a second outer surface of the foam layer facing a second direction that is opposite from the first direction;

a first plurality of molded grooves defined by the first outer surface of the exterior layer, a second plurality of molded grooves defined by the second outer surface of the interior layer, wherein at least some of the molded grooves of the first plurality of molded grooves are laterally offset from at least some of the molded grooves of the second plurality of molded grooves such that the at least some of the molded grooves of the first plurality of molded grooves are not vertically aligned with the at least some of the molded grooves of the second plurality of molded grooves, and wherein the first plurality of molded grooves and the second plurality of molded grooves form bending areas in the molded component; and a fabric layer bonded to an outermost portion of the exterior layer, wherein the fabric layer comprises a material that is stretchable in at least two directions.

2. The sports glove of claim 1, wherein the exterior layer comprises a first durometer, and the interior layer comprises a second durometer.

3. The sports glove of claim 2, wherein the first durometer is greater than the second durometer.

4. The sports glove of claim 3, wherein the foam layer is formed of dual density ethyl vinyl acetate.

5. The sports glove of claim 2, wherein the exterior layer is deformable under at least two different rates of loading, wherein deformation of the exterior layer under a first rate of loading of the at least two different rates of loading is different from deformation of the exterior layer under a second rate of loading of the at least two different rates of loading.

6. The sports glove of claim 1, wherein the at least one molded component comprises at least one of a hand portion, a cuff portion, and a wrist portion.

7. The sports glove of claim 1, wherein the at least one molded component comprises a flange that is stitched to an edge of the at least one non-molded component.

8. The sports glove of claim 7, wherein the at least one non-molded component comprises a plurality of gussets, and the at least one molded component comprises a hand portion comprising a plurality of finger portions, wherein the plurality of gussets are stitched to the plurality of finger portions.

9. The sports glove of claim 8, further comprising a palm material stitched to the plurality of gussets.

10. The sports glove of claim 9, wherein the at least one molded component further comprises at least one wrist portion stitched to the hand portion.

11. A sports glove comprising:

at least one non-molded component; and at least one molded component joined to the at least one non-molded component, wherein the at least one molded component comprises:

a foam layer comprising an exterior layer comprising a first outer surface of the foam layer and an interior layer comprising a second outer surface of the foam layer, wherein the first outer surface and the second outer surface face opposing directions;

a first plurality of molded grooves defined by the first outer surface of the exterior layer; and a second plurality of molded grooves defined by the second outer surface of the interior layer, wherein the first plurality of molded grooves and the second plurality of molded grooves form bending areas in the molded component;

at least one aperture extending through the foam layer at an intersection of at least one molded groove of the first plurality of molded grooves and at least one molded groove of the second plurality of molded grooves, wherein portions of the first plurality of molded grooves without the at least one aperture only partially penetrate a thickness of the exterior layer, and wherein portions of the second plurality of molded grooves without the at least one aperture only partially penetrate a thickness of the interior layer; and a fabric layer bonded to the exterior layer, wherein the exterior layer comprises a first durometer, wherein the interior layer comprises a second durometer, and wherein the first durometer is greater than the second durometer.

12. The sports glove of claim 11, wherein the fabric layer comprises a material that is stretchable in at least two directions.

13. The sports glove of claim 11, wherein the exterior layer is deformable under at least two different rates of loading, wherein deformation of the exterior layer under a first rate of loading of the at least two different rates of loading is different from deformation of the exterior layer under a second rate of loading of the at least two different rates of loading.

14. The sports glove of claim 11, wherein the at least one molded component comprises a flange that is stitched to an edge of the at least one non-molded component.

* * * * *